United States Patent [19]

Lin et al.

[11] Patent Number: 4,710,612

[45] Date of Patent: Dec. 1, 1987

[54] STRUCTURE OF ELECTRIC HEATER

[76] Inventors: Jong-Tsuen Lin, No. 33, Sec. 4, Chung Hsing Rd., Wu Ku Hsiang, Taipei Hsien; Chien-Han Ho, No. 8, Alley 12, Lane 91, Sec. 1, Nei Hu Rood, Taipei, both of Taiwan

[21] Appl. No.: 919,142

[22] Filed: Oct. 15, 1986

[51] Int. Cl.[4] ..... H05B 3/34; H05B 3/54

[52] U.S. Cl. ..... 219/547; 219/548; 219/549; 338/210; 338/211; 338/212

[58] Field of Search ..... 219/528, 542, 547–549; 338/210–212

[56] References Cited

U.S. PATENT DOCUMENTS 4,348,584 9/1982 Gale et al. ..... 338/212 X

*Primary Examiner*—Patrick R. Salce
*Assistant Examiner*—Emanuel Todd Voeltz
*Attorney, Agent, or Firm*—Lowe, Price LeBlanc, Becker & Shur

[57] ABSTRACT

An electric heater is described. The heater is composed of a plastic or a rubber strip conductor with a heat resistant and electric conductive chemical dispersed therethrough and electric conductors disposed on either side of the strip conductor so that when the electric conductors are coupled to a source of electrical energy current will flow through the strip and generate heat. The strip conductor then is covered with a polyethylene layer which is adhered thereto, and the polyethylene layer in turn is covered by a PVC layer.

1 Claim, 2 Drawing Figures

STRUCTURE OF ELECTRIC HEATER

BACKGROUND OF THE INVENTION

This invention relates to structure of electric heater. Conventionally, an electric heater completed with a temperature controller is built in an electric blanket, electric pad, or the like. The temperature controller is preset at a certain level to maintain temperature of the electric heater. Generally, there are two types of electric heater: Nickel-chrome wire, which can generate high heat during passing of electric current therethrough; and carbon fiber. Defects exist on both types. The first type has the following defects: (1) It is hard, it could be broken easily during assembly or moving; (2) It is not flexible and it should not be kept in touch with human body directly; (3) Its external layer would break and cause electric leakage or scalding; (4) It is not elastic and bending is difficult; (5) Heating is not even, even heating would cause overheat or burning of the heater itself; (6) Possibility of breakdown is high, and (7) It does not have nice appearance.

The second type involves complicated production process and high production cost.

In view of the above defects, the inventor created a new structure for electric heater characterized by:

(1) Its length can be increased to meet different requirements.

(2) It has good heat conductivity, even heat conductivity and permits adequate bending;

(3) it has good insulation property which eliminates the possiblity of electric leakage:

(4) It does not oxidize easily;

(5) It will not be affected by small vibration;

(6) It will not burn or breakdown during operation;

(7) It is flexible and provides sense of comfort while it is kept in touch with human body; and (8) It has a nice appearance.

SUMMARY OF THE INVENTION

The present invention provide a new structure of electric heater composed of a plastic/rubber conductor made of plastics/rubber with heat resistant and electric conductive chemical additive, two conductors at ends of the conductor, a polyethylene cover adhered by means of thermal welding process, and an uppermost PVC layer. It is heat conductive, electric insulated, soft and flexible PVC outermost layer. The present invention is completed with a temperature controller and a power switch for safe and reliable operation.

DESCRIPTION OF THE PREFERRED EMBODIMENT

Figure 1:
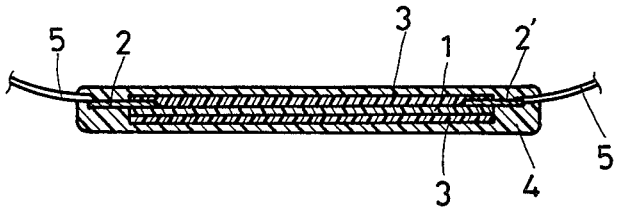
FIG. 1 is a sectional view of a preferred embodiment according to the present invention.

FIG. 1 is a sectional view of a preferred embodiment according to the present invention. As shown in the drawing, it is a strip or sheet composed of plastics or rubber and heat resistant/electric conductive chemical formed by extrusion. Extruded strip or sheet is cut to appropriate size to form plastic conductor (1). Each end of a plastic conductor (1) is adhered with a conductor (2 or 2') by means of conductive gel so that power can be conducted from the conductor (2) through the plastic conductor (1) to another conductor (2'). Because the plastic conductor (1) has a certain internal resistance, flowing of current through it will generate a certain heat energy. In order to emit heat energy from the plastic conductor safely and to provide an appropriate flexibility, the plastic conductor (1) is covered with polyethylene (3) by means of thermal welding. It will also protect the conductors (2 and 2') from loosening. Since polyethylene (3) has good heat conductivity and electric insulation, covering of polyethylene (3) on the plastic conductor (1) will prevent from breaking due to bending and maintain good theremal conductivity.

Heat resistant and soft PVC is further covering the polyethylene (3) on the plastic conductor (1). PVC is soft, and of good heat conductive, it gives no harm to humam body and it has a nice appearance, it is used as the outermost layer of the plastic conductor (1).

The plastic conductor (1) is covered with polyethylene (3) first and then with with PVC (4) by means of thermal welding process. PVC is not used to cover the plastic conductor (1) directly because the plastic conductor (1) will be at high temperature and melting point of PVC is lower than polyethylene. Of course, if temperature required is not so high, PVC can be used to cover the plastic conductor directly.

The plastic conductor (1) can be formed by compound with different electric conductive chemical contents or different electric conductive chemical materials to meet different temperature requirements.

Figure 2:
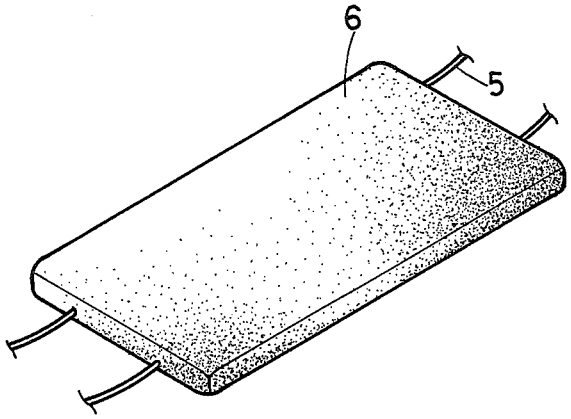
FIG. 2 is a perspective view illustrating an application of the present invention.

FIG. 2 illustrates an application of the present invention to a electric blanket/heater pad. It is made of a piece of plastic conductor according to the present invention with a fabric cover to provide warmness and comfort.

The present invention can be made in different size for different temperature to meet different requirements by varying concentration of electric conductive chemical.

We claim:

1. An electric heater comprising:

a bendable, strip conductor of a material selected from the group consisting of plastic or rubber and having an electric conductive and heat resistant chemical additive dispersed therethrough;

first and second electrical conductive means attached, respectively, to opposite sides of said strip conductor and adapter to be coupled to a source of electrical energy so that current will flow through said first means and through said strip to said second means to complete a circuit and thereby cause said strips to be heated;

a polyethylene layer adhering to and covering said strip; and a PVC layer covering said polyethylene layer whereby heat generated in said strip will be emitted through said layers.

* * * * *